US006565494B1

(12) United States Patent
Chen

(10) Patent No.: US 6,565,494 B1
(45) Date of Patent: May 20, 2003

(54) PORTABLE AND MULTIFUNCTIONAL EXERCISE DEVICE

(76) Inventor: James Chen, No. 35, Tun Hi Rd., Chin Chan Li, Sa Lu Chen, Taichung Hsien (TW)

( * ) Notice: Subject to any disclaimer, the term of this patent is extended or adjusted under 35 U.S.C. 154(b) by 0 days.

(21) Appl. No.: 09/571,724

(22) Filed: May 15, 2000

(30) Foreign Application Priority Data

Apr. 12, 2000 (TW) ..... 89205874 U

(51) Int. Cl.[7] ..... A63B 21/02
(52) U.S. Cl. ..... 482/124; 482/138; 482/908
(58) Field of Search ..... 482/92, 123, 124, 482/126, 127–130, 138, 133–136, 97, 105, 122, 137, 908

(56) References Cited

U.S. PATENT DOCUMENTS 4,898,381 A * 2/1990 Gordon ..... 482/908
5,277,684 A * 1/1994 Harris ..... 482/908
5,393,286 A * 2/1995 Cheng ..... 482/130
5,409,439 A * 4/1995 Lee ..... 482/130
5,456,644 A * 10/1995 Hecox et al. ..... 482/127
5,518,482 A * 5/1996 Hsieh ..... 482/130
6,120,421 A * 9/2000 Kuo ..... 482/129
6,234,941 B1 * 5/2001 Chu ..... 482/100
6,254,517 B1 * 7/2001 Kennedy ..... 482/121

* cited by examiner

*Primary Examiner*—Nicholas D. Lucchesi
*Assistant Examiner*—Victor Hwang
(74) *Attorney, Agent, or Firm*—Browdy and Neimark, P.L.L.C.

(57) ABSTRACT

An exercise device comprises a base, two adjustment members, two pull rods, and two damping members. The base has a frame and a soft pad fastened to one side of the frame. The adjustment members are oppositely mounted on the frame. The two pull rods are pivoted to the adjustment members and provided with a curved rod and a handle corresponding in location to the soft pad. The damping members are fastened with the curved rods and the frame for providing the resistance against the pull rods which are pulled by the external force.

14 Claims, 8 Drawing Sheets

PORTABLE AND MULTIFUNCTIONAL EXERCISE DEVICE

FIELD OF THE INVENTION

The present invention relates generally to an exercise device, and more particularly to a multifunctional exercise device which is portable.

BACKGROUND OF THE INVENTION

There are a variety of exercise devices which are designed for use in doing a specific exercise and are rather cumbersome.

SUMMARY OF THE INVENTION

The primary objective of the present invention is to provide a multifunctional exercise device which can be easily carried or moved.

The exercise device of the present invention comprises a base, two adjustment devices, two pull rods, and two damping members. The base has a frame and a soft pad fastened to one side of the frame. The two adjustment devices are mounted oppositely on the frame. The two pull rods are pivoted to the adjustment devices and provided with a curved rod and a handle corresponding in location to the soft pad. The damping members are fastened respectively with the curved rod and the frame for providing the resistance forces against both hands of an exerciser pulling the two pull rods.

DETAILED DESCRIPTION OF THE INVENTION

Figure 1:
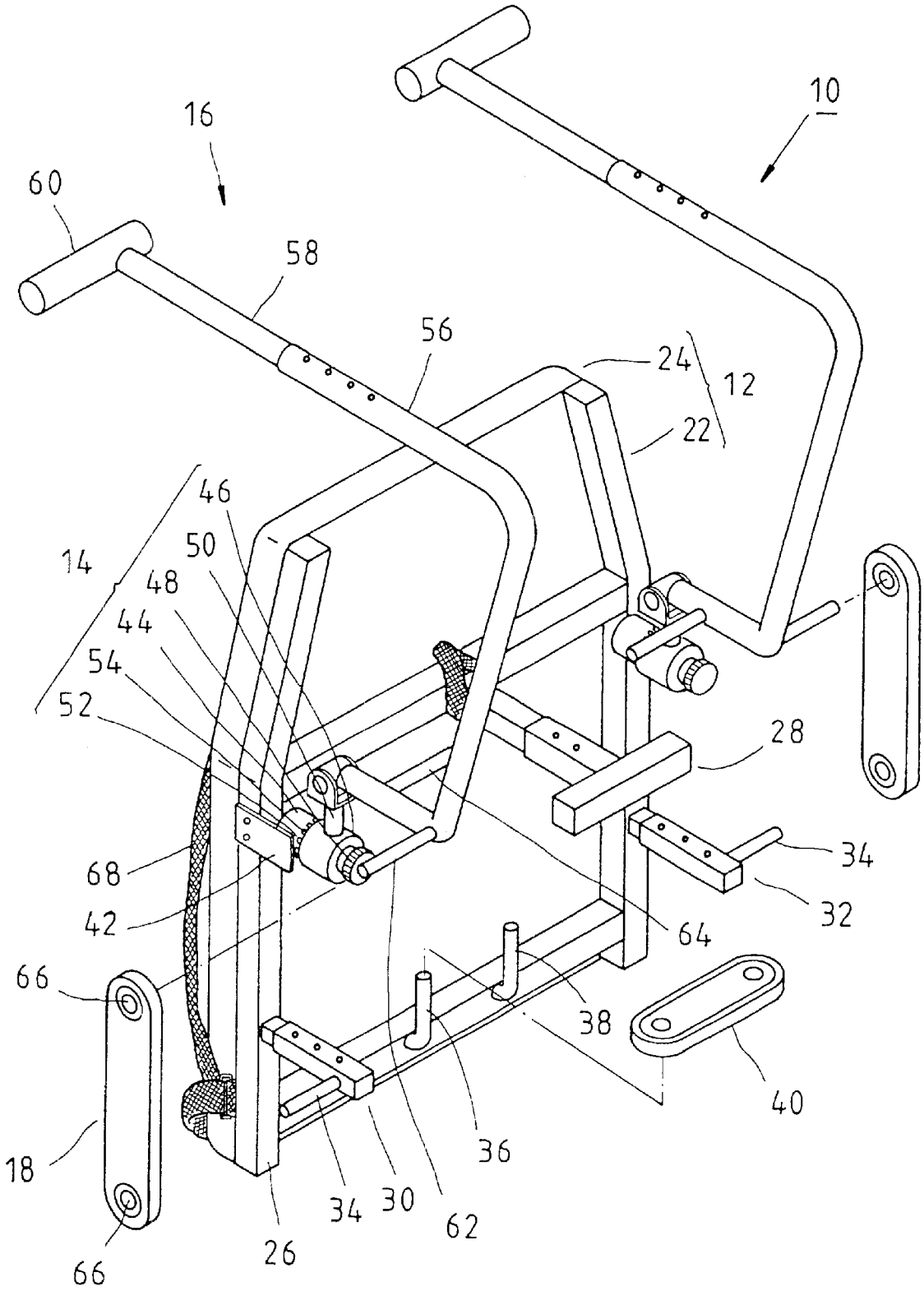
FIG. 1 shows a partial exploded view of a first preferred embodiment of the present invention.

As shown in FIG. 1, an exercise device 10 embodied in the present invention comprises a base 12, two adjustment devices 14, two pull rods 16, and two damping members 18.

The base 12 has a frame 22 and a soft pad 24 fastened to one side of the frame 22. The frame 22 has a frame body 26, three expansible support rods 28, 30 and 32, and two carrying rods 36 and 38. The support rods 28, 30 and 32 are mounted on the outer side of the frame body 26 such that the support rods 30 and 32 are fastened with a first connection rod 34. The two carrying rods 36 and 38 are mounted at an interval on the bottom side of the frame 22 for carrying a predetermined number of metal weights 40. The frame body 26 is provided with two carrying pieces 42 fastened therewith.

The adjustment devices 14 are conventional locating devices and are formed of a hollow bottom seat 44, a hollow rotary seat 46, a bolt 48 engaging the bottom seat 44 and the rotary seat 46, and a spring (not shown in the drawing) disposed between the bottom seat 44 and the rotary seat 46. The rotary seat 46 is provided with a pivot seat 50 adjustable in position by unfastening the bolt 48 to allow the rotary seat 46 to be pushed by the spring to move outwards an appropriate distance, thereby enabling the rotary seat 46 to be rotated an angle to move the pivot seat 50 to a predetermined position. Upon fastening the bolt 48, the rotary seat 46 is secured on the bottom seat 44 by a plurality of retaining slots 52 and 54.

The pull rods 16 have a hollow curved rod 56 which is pivoted at one end to the pivot seat 50, a movable rod 58 movably fastened with the curved rod 56, a handle 60 fastened with the movable rod 58 such that the handle 60 is corresponding in location to the soft pad 24. The curved rod 56 is provided with two second connection rods 62 and 64 corresponding in location to one end of the pivot seat 50.

The damping members 18 are rubber pieces having an appropriate elasticity and are provided with two fastening holes 66 by means of which the damping members 18 are fastened with the first connection rod 34 and the second connection rods 62 and 64. The connection rods 34, 62, and 64 are provided with a removable C-shaped ring (not shown in the drawing) for preventing the damping members 18 from slipping out.

The present invention further comprises a back strap 68 adjustable in length. The strap 68 is fastened at both ends thereof with two ends of the bottom side of the frame body 26 such that the midsegment of the strap 68 is put through the soft pad 24 before being disposed on the support rod 28.

Figure 2:
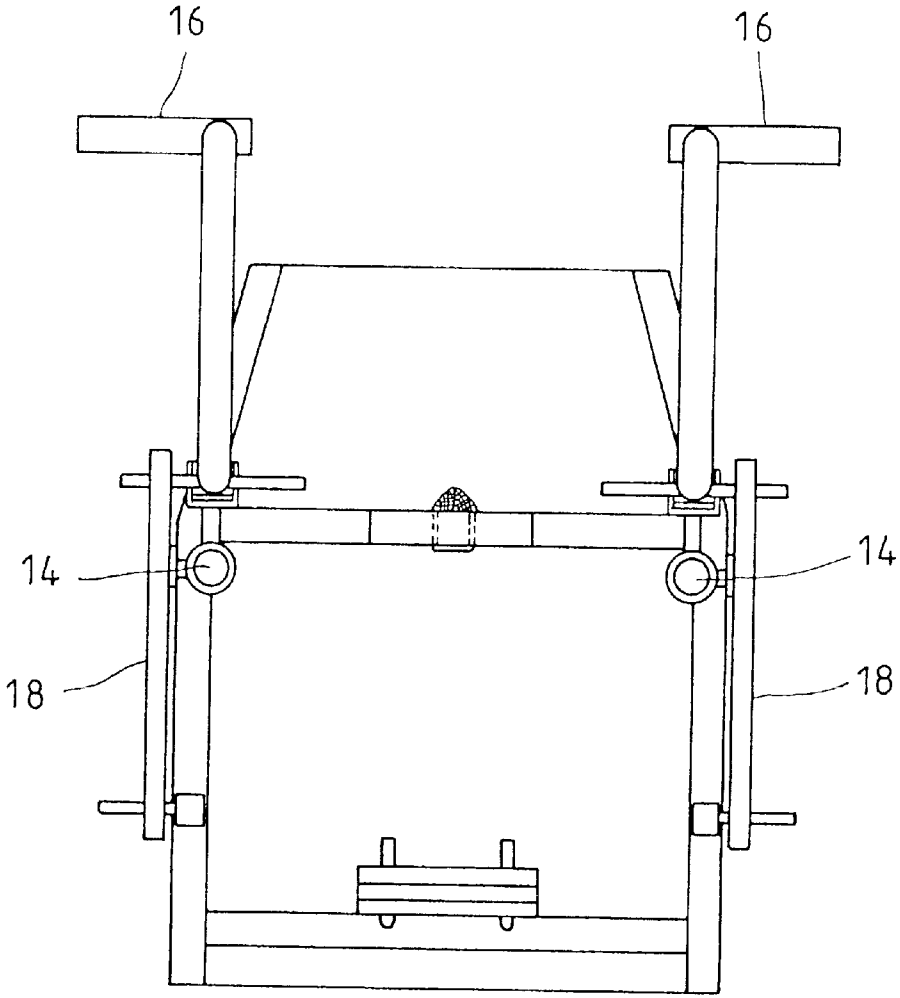
FIGS. 2–4 are schematic views of the pull rods and the damping members of the first preferred embodiment of the present invention in motion.
Figure 3:
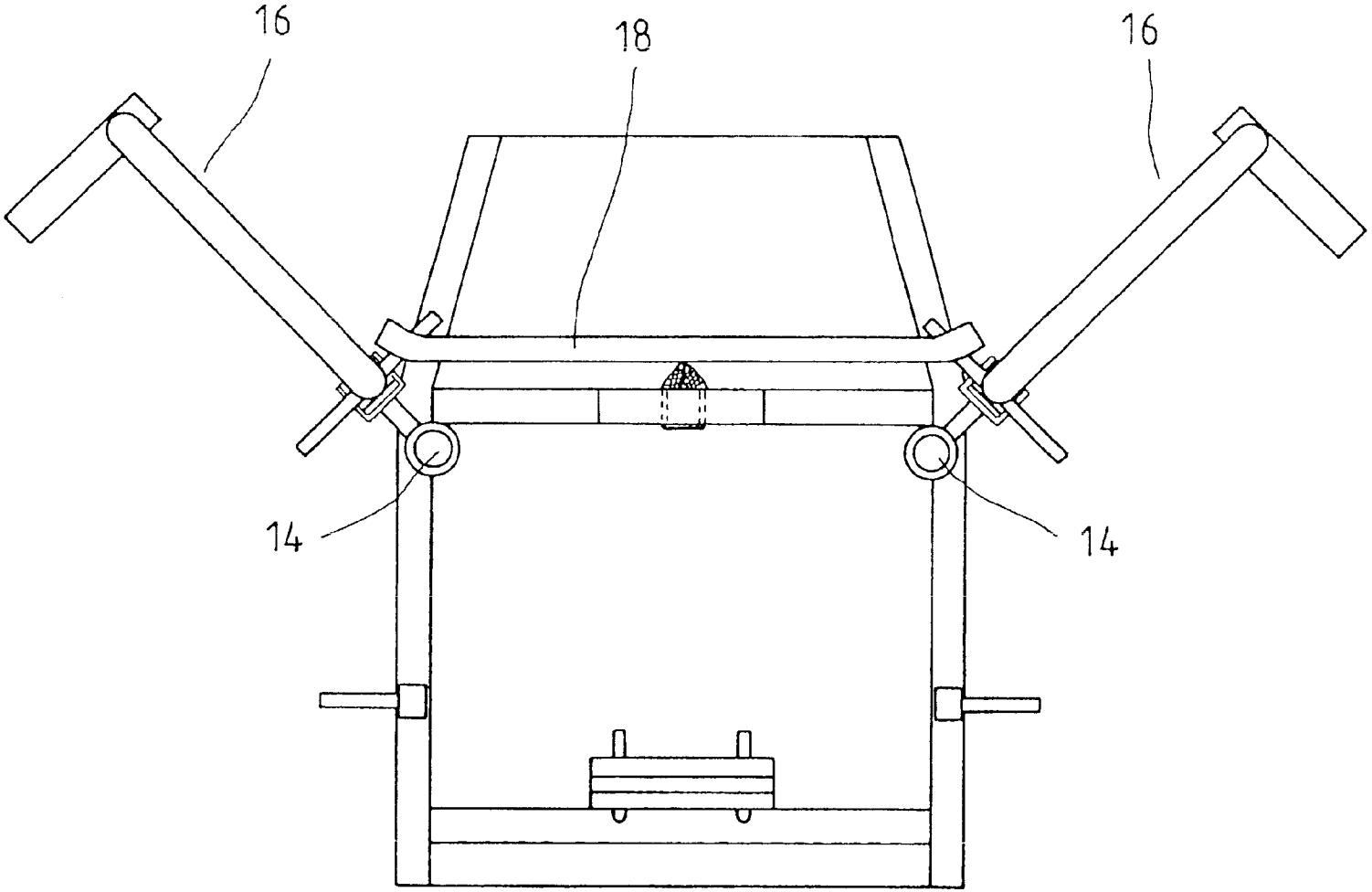
Figure 4:
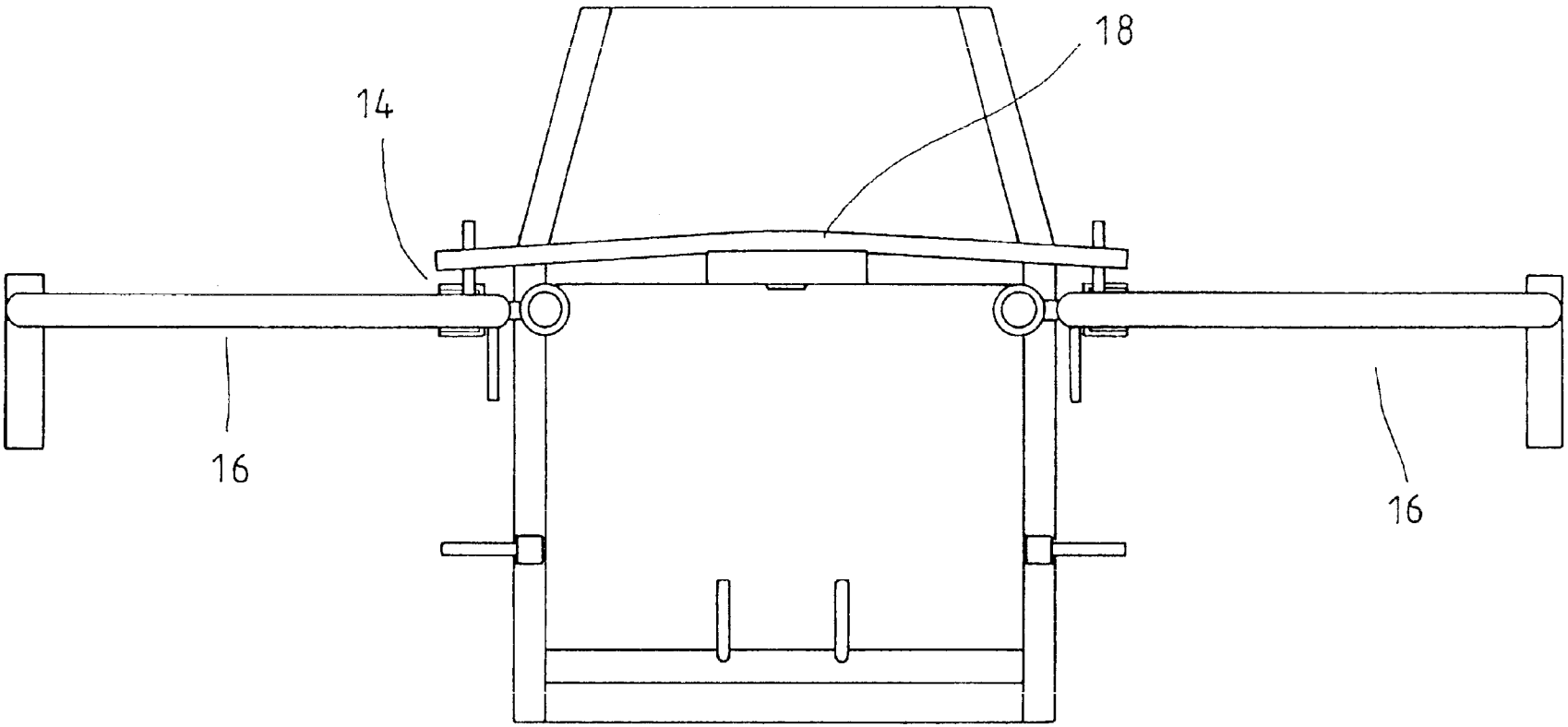

As shown in FIGS. 2–4, after adjustment in position of the rotary seat 46 by the adjustment devices 14, the pull rods 16 can be swiveled for building muscles of various parts of a human body.

Figure 5:
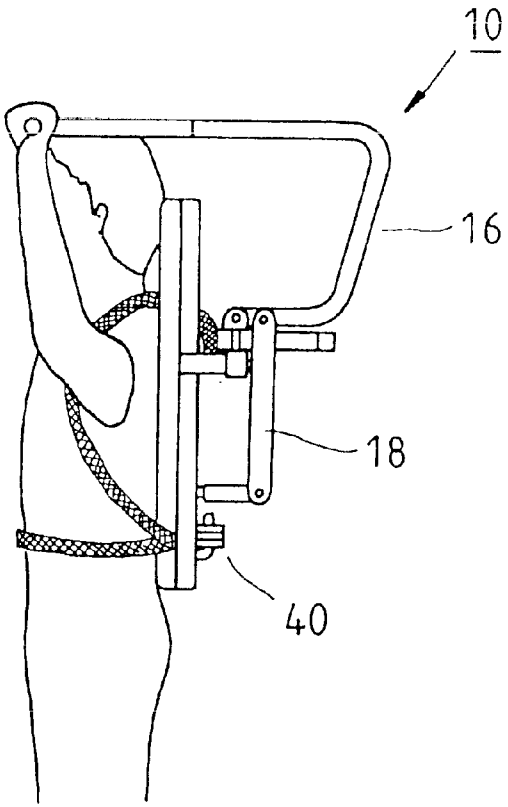

As shown in FIG. 5, the exercise device 10 is restrained by the back strap 68. With both hands holding the handles 60, an exerciser pulls the pull rods 16 by overcoming the resistance forces of the damping members 18 for building the muscles of arms, shoulder and back of the exerciser. In the meantime, the body of the exerciser is stabilized by the back strap 68 which presses against the belly of the exerciser at the time when the exercise device 10 in operation is slightly lifted. As the exerciser pulls the pull rods 16, the exerciser must stand still, thereby putting a pressure on the belly of the exerciser. The exercising effect on the muscles of both feet and belly of the exerciser is thus brought about. The exercise device 10 of the present invention is so portable that it can be used at any place. The metal weights 40 may be used to enhance the exercising effect of the exercise device 10 of the present invention.

Figure 6:
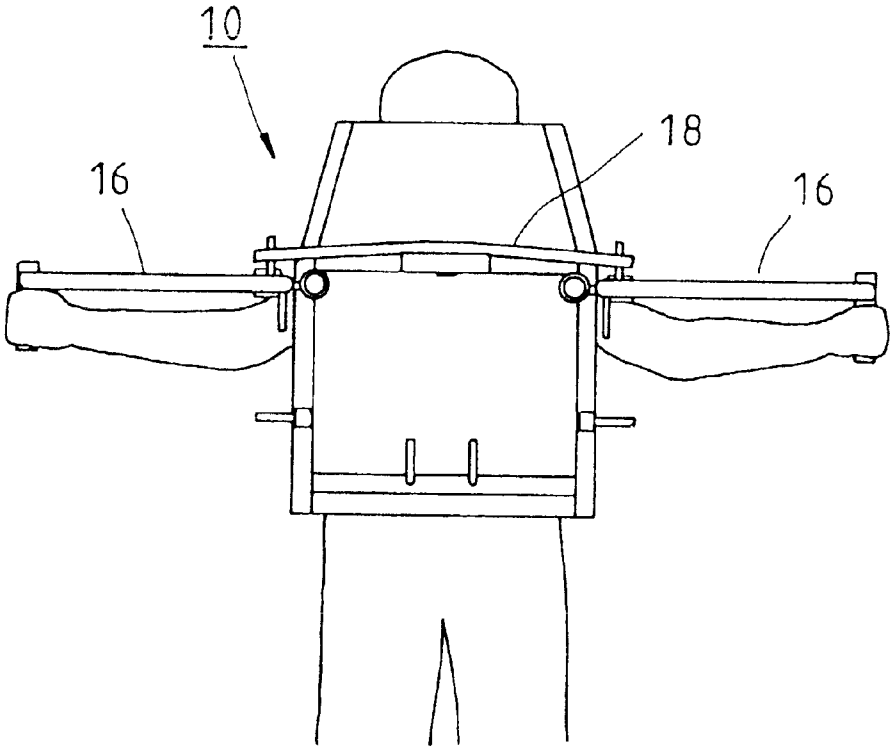
FIGS. 5 and 6 are schematic views of the first preferred embodiment of the present invention in action.

As shown in FIG. 6, the pull rods 16 are parallel to the floor surface such that the damping members 18 are disposed on the second connection rod 64. As the pull rods 16 are pulled forward by an exerciser, the exercising effect is brought about on biceps, deltoids, and pectoral muscles.

Figure 8:
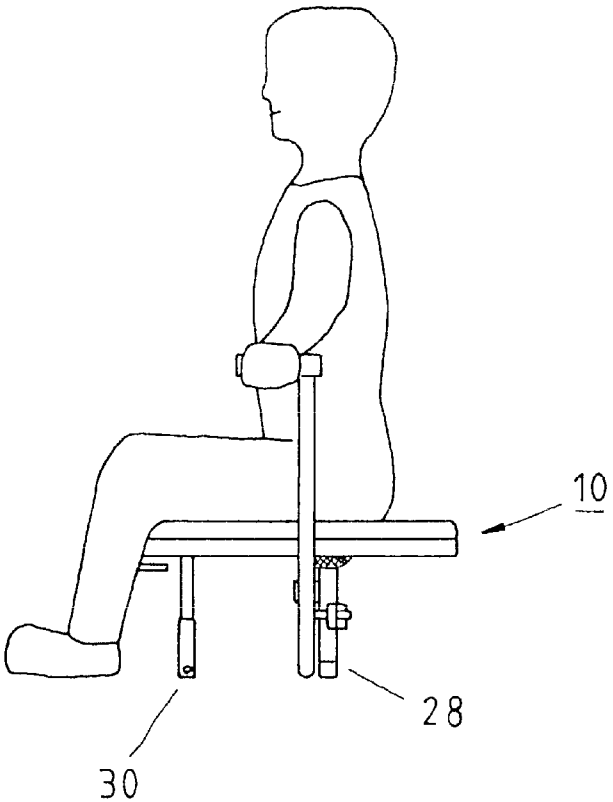
FIG. 8 shows a schematic view of the operation of the first preferred embodiment of the present invention by an exerciser sitting on the base.
Figure 7:
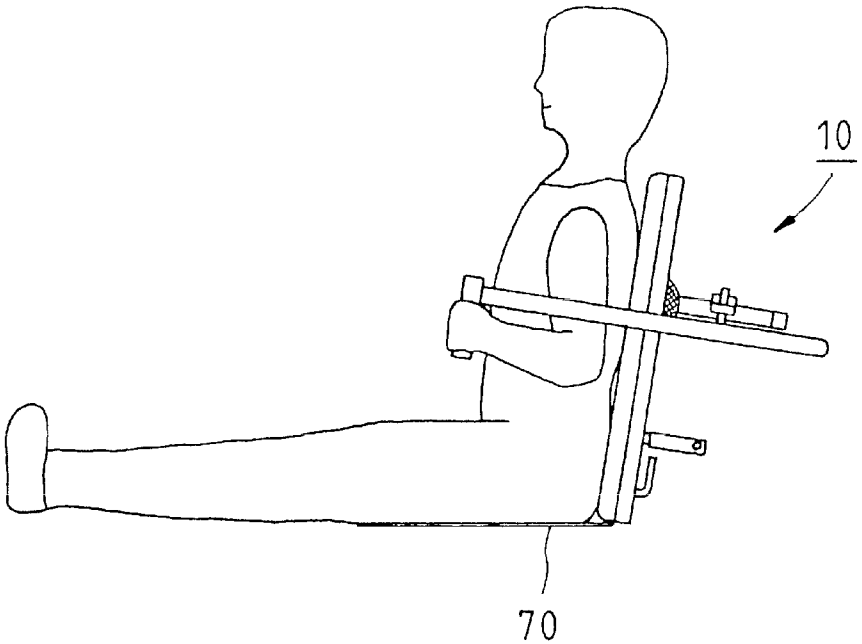
FIG. 7 shows a schematic view of the operation of the first preferred embodiment of the present invention by an exerciser sitting on the floor.

As shown in FIG. 7, an exerciser uses the exercise device 10 of the present invention while the exerciser is seated on a soft pad 70 which is placed on the floor. As shown in FIG. 8, the exerciser is seated on the soft pad 24 while using the exercise device 10 which is supported on the floor by the support rods 28, 30, and 32.

The pull rods 16 and the support rods 28, 30, and 32 may be expansible to facilitate the use of the exercise device 10 by persons of various sizes.

Figure 9:
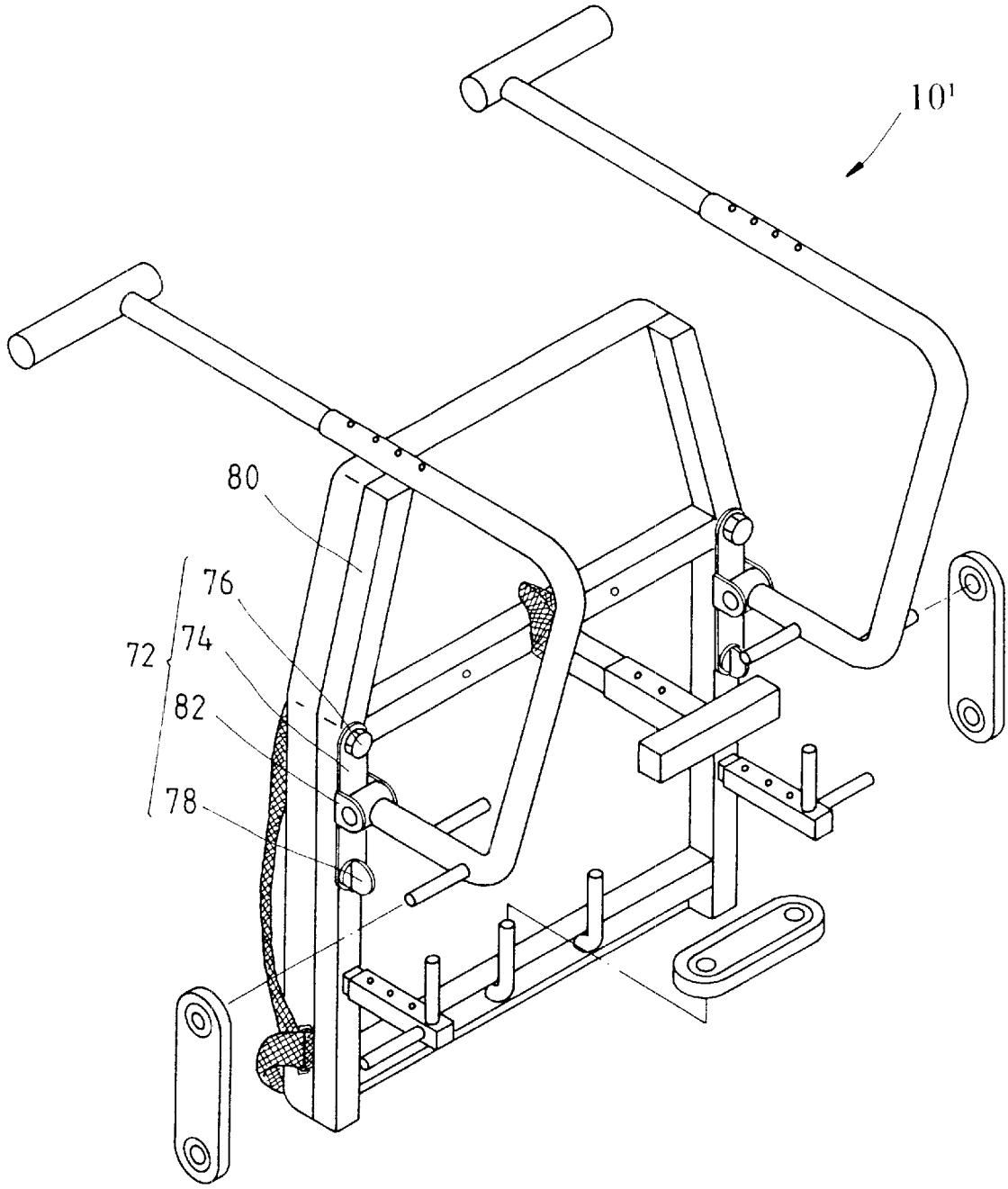
FIG. 9 shows a perspective view of a second preferred embodiment of the present invention.
Figure 10:
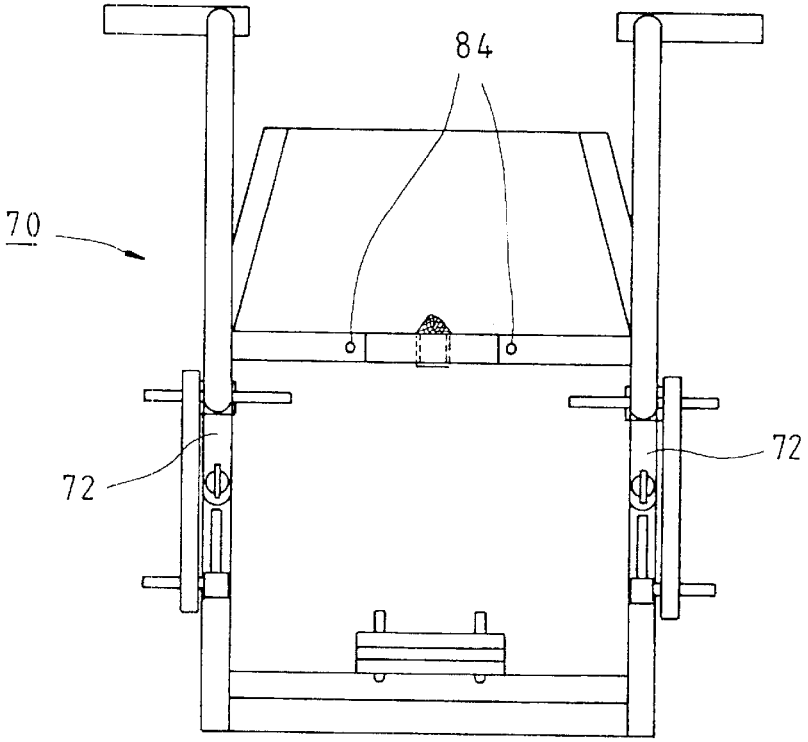
FIGS. 10 and 11 are schematic views of the pull rods and the damping members of the second preferred embodiment of the present invention in motion.
Figure 11:
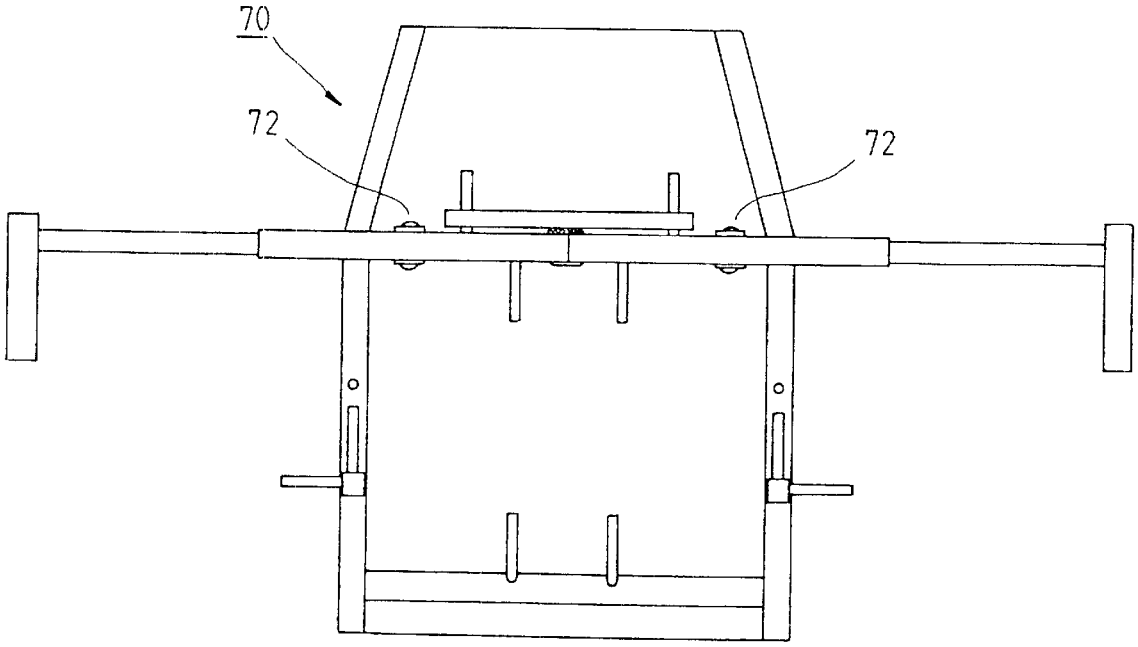

As shown in FIG. 9, an exercise device 10' of the second preferred embodiment of the present invention is different from the exercise device 10 in that the former comprises the adjustment devices 72, with each having a bottom plate 74 which is pivoted to a frame body 80 by a pivot 76 and a rotary button 78 and is provided with a pivoting seat 82. As illustrated in FIGS. 10 and 11, the adjustment devices 72 are adjusted in position by removing the rotary buttons 78 so as to swing the bottom plate 74 upward to be located on the frame body 80 by the rotary button 78 which is engaged with a threaded hole 84 of the frame body 80. The exercise device 10' can be used to exercise one's hands.

What is claimed is:

1. An exercise device comprising:

a base having a frame and a pad fastened to one side of the frame;

a back strap engaged to the base;

a pair of adjustment devices respectively mounted on opposite sides of the frame;

a pair of pull rods each one of which is rotatably and respectively engaged to one of the pair of adjustment devices;

a pair of damping devices each one of which is respectively engaged between one of the pull rods and the frame to provide resistance against the pull rods when pulled toward the frame;

wherein each one of the pair of adjustment devices are respectively adjustable with one of the pull rods to allow respective rotation of each of the pull rods around an axis of the corresponding adjustment device to different selected positions which can be fixed; and wherein when the pull rods are in a selected position the pull rods can each rotate within a plane through an entire length of the axis of and relative to the corresponding adjustment device when pulled.

2. The exercise device according to claim 1, wherein the frame has a plurality of support rods.

3. The exercise device according to claim 2, wherein said support rods are expansible along an axial direction.

4. The exercise device according to claim 2, wherein each of the damping devices is connected between a connection rod on one of the pull rods and a connection rod on the frame.

5. The exercise device according to claim 4, wherein each of the pull rods has two connection rods extending out from opposite sides of the pull rod for selective engagement to one of the damping devices dependent on the selected position that the pull rod has been rotated to around the axis of the adjustment device.

6. The exercise device according to claim 4, wherein each one of the connection rods on the frame are respectively fixed to one of the support rods on the frame.

7. The exercise device according to claim 4, wherein each of said damping devices are provided at opposite ends thereof with a fastening hole for engaging said damping members to corresponding connection rods on the pull rods and the frame.

8. The exercise device according to claim 1, wherein said frame is provided with two carrying rods for carrying a plurality of weights.

9. The exercise device as defined in claim 1, wherein each of said adjustment devices are provided with a bottom seat, a rotary seat rotatably mounted on said bottom seat, and a pivoting seat disposed on said rotary seat engaged to said pull rod.

10. The exercise device according to claim 1, wherein each of said adjustment devices are provided with a bottom plate which is fastened with said frame by a pivot and a rotary button, said frame provided with two threaded holes for engaging said rotary button at such time when said bottom plate is swiveled on said pivot to be fixed on said frame.

11. The exercise device according to claim 1, further comprising a pad piece connected with one side of said base.

12. The exercise device according to claim 1, wherein each of said pull rods has one end expansible along an axial direction.

13. The exercise device according to claim 1, wherein each of said pull rods is curved and has a handle at a free end.

14. The exercise device according to claim 1, wherein the plane is substantially perpendicular to a plane in which the frame lies.

* * * * *